US005242270A

United States Patent [19]

Partington et al.

[11] Patent Number: 5,242,270

[45] Date of Patent: Sep. 7, 1993

[54] PLATFORM MOTION RESTRAINTS FOR FREESTANDING TURBINE BLADES

[75] Inventors: Albert J. Partington; Wilmott G. Brown, both of Winter Park, Fla.

[73] Assignee: Westinghouse Electric Corp., Pittsburgh, Pa.

[21] Appl. No.: 828,836

[22] Filed: Jan. 31, 1992

[51] Int. Cl.[5] ..... B63H 1/20

[52] U.S. Cl. ..... 416/248; 416/193 A; 416/219 R; 416/500

[58] Field of Search ..... 416/248, 219 R, 220 R, 416/500, 193 A

[56] References Cited

U.S. PATENT DOCUMENTS

| | | | |
|---|---|---|---|
| 2,843,356 | 7/1958 | Hull, Jr. | 416/220 R |
| 2,867,408 | 1/1959 | Kolb et al. | 416/220 R |
| 3,112,914 | 12/1963 | Wellman | 416/219 |
| 3,198,485 | 8/1965 | Melenchuck | 416/220 R |
| 3,202,398 | 8/1965 | Webb | 416/220 R |
| 3,575,522 | 4/1971 | Melenchuck | 416/220 R |
| 3,904,317 | 9/1975 | Cardin et al. | 416/220 R |
| 3,930,751 | 1/1976 | Straslicka et al. | 416/500 |
| 4,915,587 | 4/1990 | Pisz et al. | 416/220 R |
| 5,067,876 | 11/1991 | Moreman, III | 416/219 R |
| 5,123,813 | 6/1992 | Przytulski et al. | 416/500 |

FOREIGN PATENT DOCUMENTS

| | | | |
|---|---|---|---|
| 607452 | 10/1960 | Canada | 416/500 |
| 1204858 | 8/1959 | France | 416/500 |

*Primary Examiner*—John T. Kwon

[57] ABSTRACT

A platform motion restraint for freestanding blades having Christmas tree shaped roots comprising a plurality of L shaped members which fit in circumferential notches machined in the outer portion of rotor steeples, one leg of the L shaped member being forced into the groove under platform portions of the blade to move the blades radially outward and the other leg filling the gap between adjacent blades.

10 Claims, 3 Drawing Sheets

PLATFORM MOTION RESTRAINTS FOR FREESTANDING TURBINE BLADES

CROSS REFERENCE TO RELATED APPLICATIONS

This application is related to a co-pending application entitled Turbine Blade Assembly, filed Apr. 29, 1991 and given Ser. No. 07/693,256.

BACKGROUND OF THE INVENTION

The invention relates to a steam turbine and more particularly to platform motion restraints for freestanding turbine blades when the turbine is on turning gear.

When the turbine is operating, the blade roots are held tight in the rotor blade grooves by centrifugal force, but when the turbine is on turning gear rotating at about 3 revolutions per minute there is negligible centrifugal force. Gravity pulls the distal ends of the blades downwardly when in the 3 and 9 o'clock positions producing a rocking motion at the root due to the required clearances between the blade root and the rotor grooves. This repetitive small motion between the blade root and rotor groove causes fretting, a combination of wear and corrosion, that leads to cracking in the highly stressed root area of the blade.

SUMMARY OF THE INVENTION

Among the objects of the invention may be noted the provision of means for preventing motion between the blade root and the rotor groove when on turning gear to substantially reduce fretting between the blade root and the rotor groove while not affecting the natural frequency of the freestanding blades.

In general, a platform motion restraint for freestanding turbine blades having a Christmas tree shaped root with platform portion disposed adjacent thereto and a turbine rotor having blade grooves which form Christmas tree shaped steeples on the outer periphery of the rotor, when made in accordance with this invention, comprises a circumferential notch extending across the distal end of each steeple and a plurality of L shaped members having one leg which fits within said notch and another leg which fills a gap disposed between the platform portions of adjacent blades.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

DESCRIPTION OF THE PREFERRED EMBODIMENT

Figure 1:
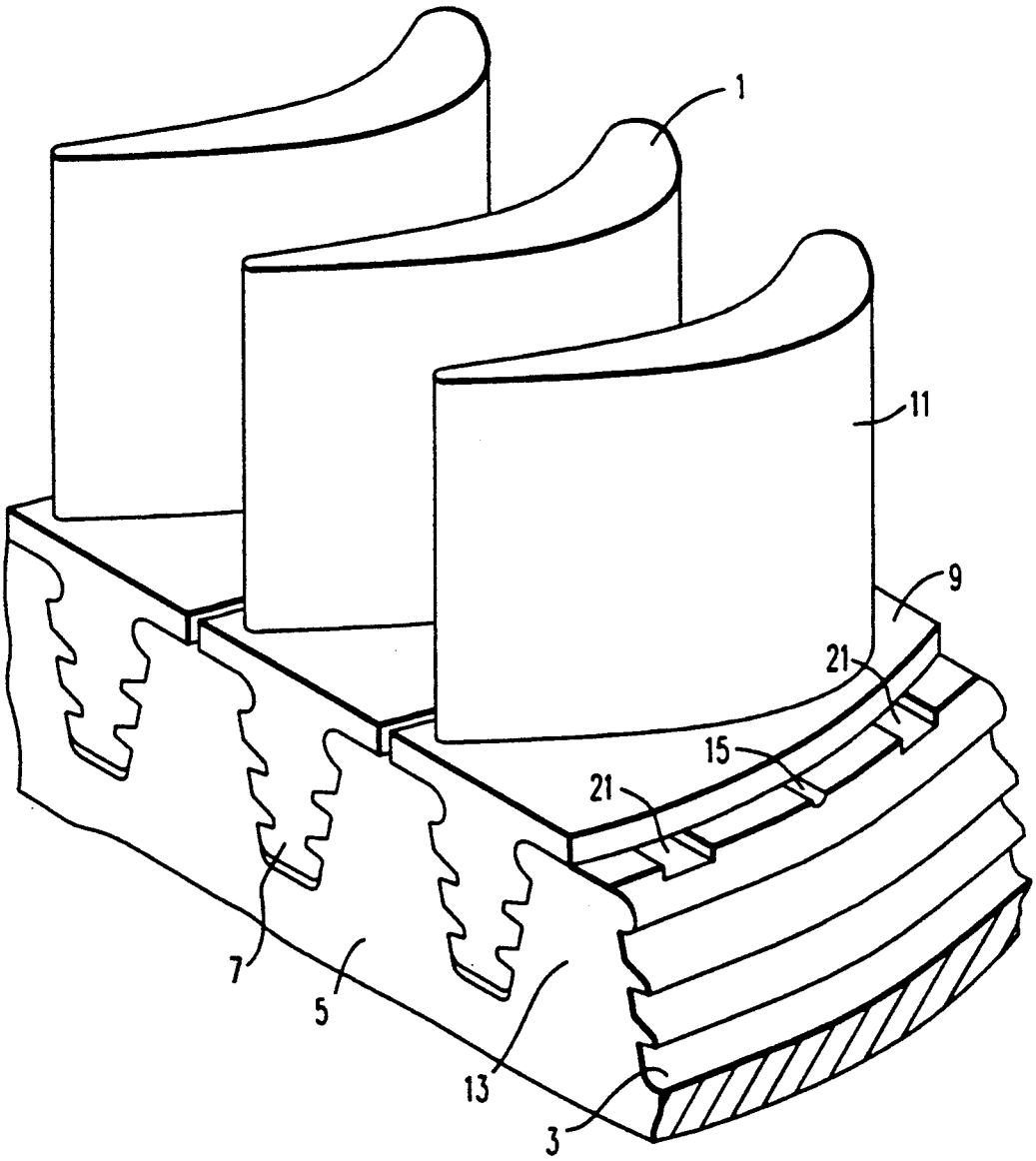
FIG. 1 is a pictorial view of a plurality of rotor steeples with the first and second blades installed in the rotor grooves.

Referring now to the drawings in detail and in particular to FIG. 1 there is shown a portion of a row of rotating freestanding blades 1 disposed in grooves 3 machined in a turbine rotor 5. The freestanding blades 1 have Christmas tree shaped roots or root portions 7 and platform or platform portions 9 which are curved to provide support for curved freestanding blade air foil portions 11 which extends from the platform portions 9. The grooves 3 machined in periphery of the rotor 5 are curved to accept the curved blade roots 7 forming curved Christmas tree shaped steeples 13. The steeples 13 have three circumferential notches extending across the distal end of each steeple 13.

Figure 2:
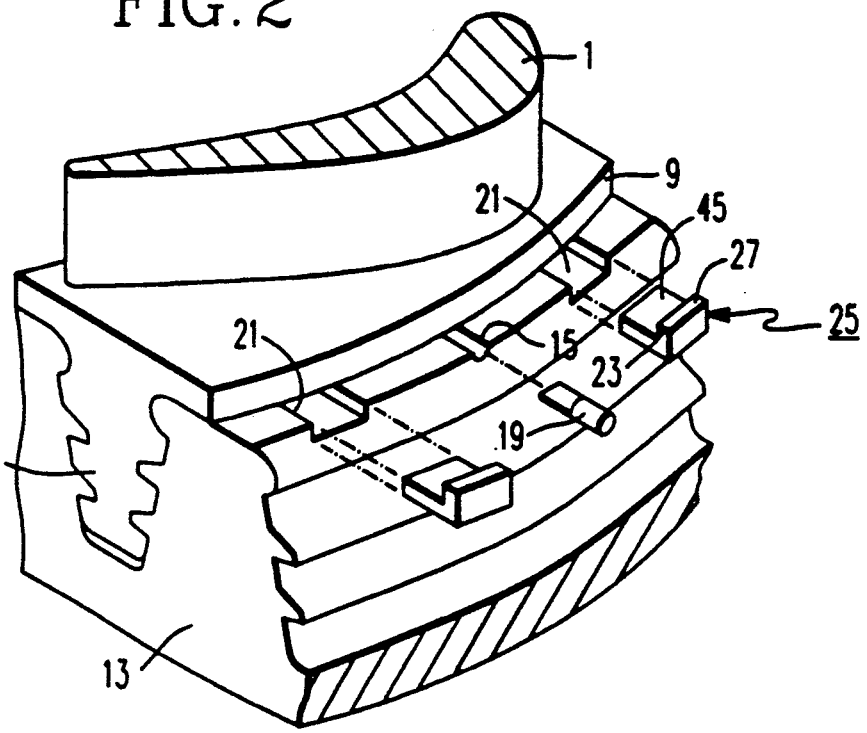
FIG. 2 is an exploded pictorial view of a steeple showing an L shaped member and a blade locking pin.

As shown in FIG. 2, a semicircular notch 15 is disposed in the central portion of the steeple 13 and registers with a semicircular notch (not shown) in the platform 9 for receiving a locking pin 19, which when installed prevents axial movement of the blades 1 locking the blade roots 7 in the grooves 3. The other two notches 21 are rectangular in cross section and are disposed adjacent the inlet and exit ends of the steeples 13. These outboard notches 21 are shaped to receive one leg 23 of an L shaped member 25. The one leg 23 is thicker than the notch 21 is deep, so that when installed, as shown in FIG. 3, there is an interference fit between the bottom of the notch 21, the platform 9 and the one leg 23 forcing the blade 1 radially outward to generally provide contact between the blade root 7 and the steeple 13.

Figure 3:
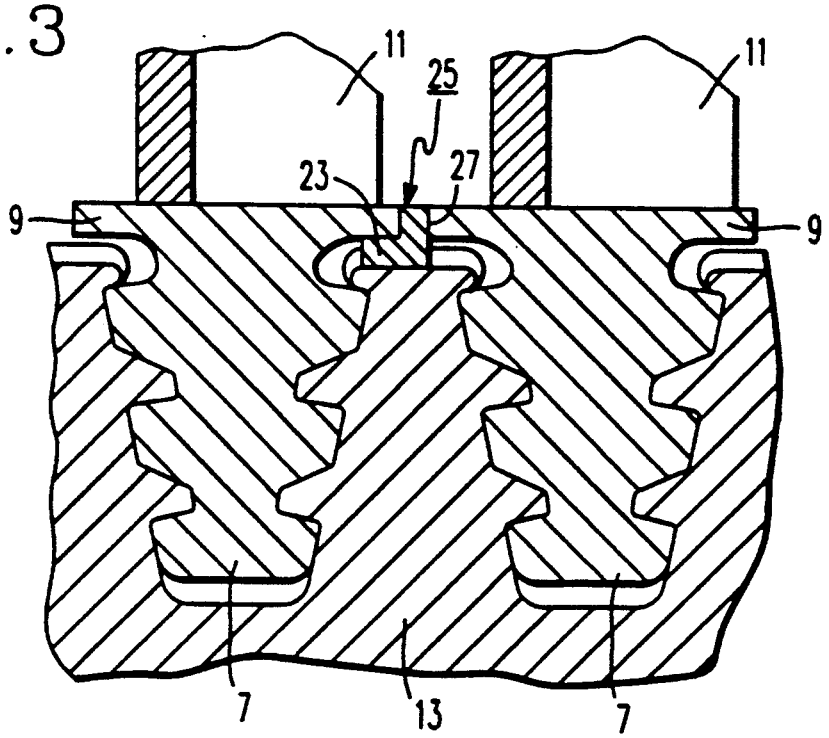
FIG. 3 is a partial sectional view of a steeple and pair of rotating blade roots showing an L shaped member disposed between the blade platforms and the steeple.
Figure 4:
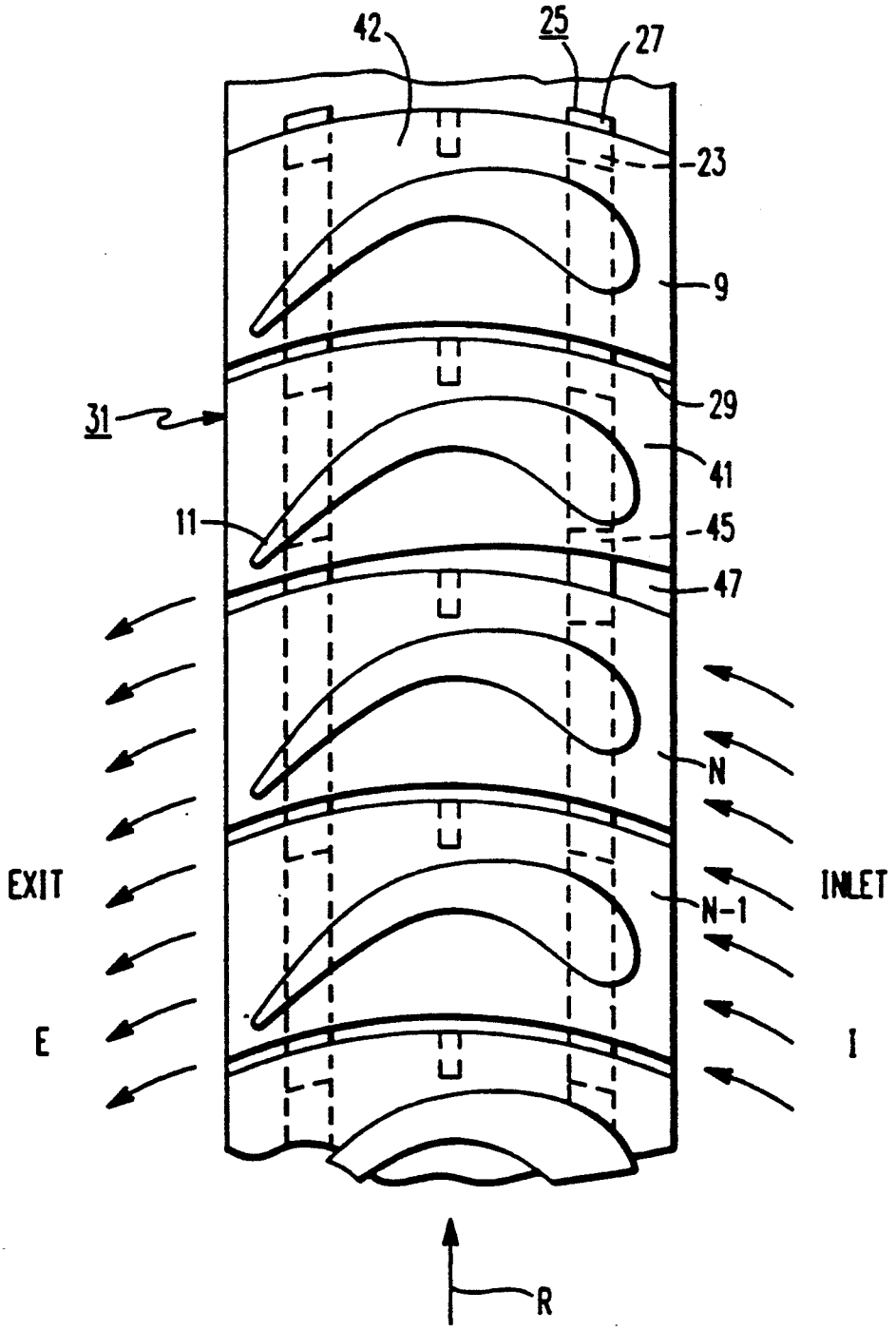
FIG. 4 is a schematic view of the platforms of a partial row of turbine blades.

As shown in FIGS. 3 and 4, another leg 27 of the L shaped member fills a gap 29 between the platforms 9, the gap 29 is exaggerated to illustrate the other legs 27. The other legs 27 provide tangential contact with the platforms 9 and cooperate with the one leg portion 23 of the L shaped members 25 to prevent the rocking motion of the blades 1 in the turbine rotor 5. A portion of a blade row 31 is shown in FIG. 4 along with the direction of rotation of the turbine rotor 5 which is indicated by an arrow R. Steam flow to the blade row 31 is from right to left. A group of arrows I indicate the inlet steam flowing to the blade row 31 and a group of arrows E indicate steam exiting from the blade row 31.

When assembling the freestanding blades 1 in the turbine rotor 5 a first blade 41 is inserted into the groove 3 in the rotor 5 and the one leg 23 of the L shaped members 25 are forced into the notches 21 on the convex side of the platform 9 producing an interference fit. A root portion 7 of a second blade 42 is inserted into the adjacent groove 3 on the convex side of the first blade 41. The second blade 42 is normally inserted from the inlet side of the blade row 31, however if interference of the blade air foils 11 is encountered and installation from inlet side is not possible then the blades 1 are inserted from the exit side of the blade row 31. With the inserted blade in place in the groove 3, two L shaped members are forced into the notches 21 from the convex side of the second blade 42. Successive blades 1 are installed in the direction of rotation R in the same manner. In installing a last blade or closing blade N the L shaped member 25 is installed with the one leg 23 forced into the notch 21 under the platform 9 on the concave side of the first installed blade 41 on the exit side of the blade row 31. A flat strip 45 is inserted into the open notch 21 on the inlet side of the blade row 31 and forced into the notch 21 under the platform 9 of the first blade 41 from the concave side and extends into the notch 21 over which the last blade N is to be inserted. The portion of the flat strip 45 inserted under the platform of the first blade 41 is slightly thicker than the portion of another strip 45 which will reside under the platform of the last blade N. The blade root 7 of the last or closing blade N is inserted into the remaining open groove 3 from the inlet side of the blade row 31 and forced over the flat strip 45. The first blade 41 may have a wedge shaped portion of its platform 9 cut away as generally indicated at 47 to allow the closing blade N to be inserted into the last open groove 3. If necessary the closing blade N may be inserted by scissoring the last blade N with an adjacent blade N minus 1.

With all of the blades 1 in place in the rotor 5, the other legs 27 of the L shaped member 25 are upset causing them to expand to fill the gap between adjacent blades. Thus restraining the blades in the grooves 3 substantially in the position they take when the turbine is running at low speed even when operating on turning gear and restraining the rocking motion which results in fretting. These platform restraints can be used alone on smaller blade roots or in conjunction with biasing springs disposed between the bottom of the blade root and the bottom of the groove when the blade roots are large. When the rotor is operating at normal rotating speed the high centrifugal force will loosen the L shaped members slightly. Advantageously the natural frequencies of the rotating blades 1 will not be affected by the L shaped members. The L shaped members 25 also advantageously form a barrier to reduce the leakage of steam through the gaps between and under the platforms 9.

While the preferred embodiments described herein set forth the best mode to practice this invention presently contemplated by the inventors, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

What is claimed is:

1. A platform motion restraint for freestanding turbine blades having a curved Christmas tree shaped root with a curved platform portion disposed adjacent thereto and a turbine rotor having blade grooves which form curbed Christmas tree shaped steeples on the outer periphery of the rotor, said motion restraint comprising a circumferential notch extending across the distal end of each steeple and a plurality of L shaped members having one leg which fits within said notch and another leg which fills a gap disposed between the platform portions of adjacent blades, wherein the platform of the first blade inserted into the rotor grooves has a wedge shaped portion removed from the concave side adjacent a steam inlet end of the platform allowing all other blades to be inserted serially into the grooves in the direction of rotation of the rotor.

2. The platform motion restraint of claim 1, wherein the steeples each have two notches aon adjacent each axial end thereof and an L shaped member is generally disposed in each notch.

3. The platform motion restraint of claim 1, wherein the one leg of the L shaped member is disposed in the groove under the convex side of the platform.

4. The platform motion restraint of claim 1, wherein the one leg of the L shaped member is thicker than the depth of the notch.

5. The platform motion restraint of claim 3, wherein the one leg of the L shaped member has a thickness sufficient to form a interference fit when disposed between the platform and the bottom of the notch.

6. The platform motion restraint of claim 1, wherein the other leg of the L shaped member is upset after the adjacent blades are installed to fill the space between adjacent platforms.

7. The platform motion restraint of claim 1, wherein the notch adjacent the inlet end of the first and last blades to be inserted into the rotor grooves has a flat strip disposed therein.

8. The platform motion restraint of claim 7, wherein the flat strip disposed in the notch adjacent the inlet end of the first blade is thicker than another flat strip disposed in the notch adjacent the inlet end of the last blade.

9. The platform motion restraint of claim 7, wherein the one leg L shaped member disposed between the first and last blade adjacent the steam exit end of the blades is inserted under the first blade on the concave side thereof.

10. The platform motion restraint of claim 7, wherein the legs of the L shaped members form a barrier to reduce leakage through the gaps between and under the platforms.

* * * * *